US011536420B1

(12) United States Patent
Glazer et al.

(10) Patent No.: US 11,536,420 B1
(45) Date of Patent: Dec. 27, 2022

(54) LIGHT FIXTURE WITH FLANGE OVER GOOSE NECK CONNECTION

(71) Applicant: Inter-Global, Inc., St. Louis, MO (US)

(72) Inventors: Larry J. Glazer, St. Louis, MO (US); Wendell S. Dodson, St. Louis, MO (US)

(73) Assignee: Inter-Global, Inc., St. Louis, MO (US)

( * ) Notice: Subject to any disclaimer, the term of this patent is extended or adjusted under 35 U.S.C. 154(b) by 0 days.

(21) Appl. No.: 17/551,410

(22) Filed: Dec. 15, 2021

(51) Int. Cl.

| | |
|---|---|
| ***F21S 2/00*** | (2016.01) |
| ***F21S 8/00*** | (2006.01) |
| ***F21V 3/02*** | (2006.01) |
| ***F21V 17/00*** | (2006.01) |
| ***F21V 15/02*** | (2006.01) |
| ***F21Y 115/10*** | (2016.01) |
| ***F21Y 105/18*** | (2016.01) |

(52) U.S. Cl.
CPC ..... *F21S 2/005* (2013.01); *F21S 8/036* (2013.01); *F21V 3/02* (2013.01); *F21V 15/02* (2013.01); *F21V 17/002* (2013.01); *F21Y 2105/18* (2016.08); *F21Y 2115/10* (2016.08)

(58) Field of Classification Search
CPC .. F21S 2/005; F21S 8/036; F21V 3/02; F21V 15/02; F21V 17/002; F21V 21/02; F21Y 2105/18; F21Y 2115/10
See application file for complete search history.

(56) References Cited

U.S. PATENT DOCUMENTS

| | | | | |
|---|---|---|---|---|
| 1,767,585 | A | 4/1929 | Hebendahl | |
| 2,293,776 | A | 5/1939 | Steber | |
| 5,251,118 | A | 10/1993 | Budnovitch et al. | |
| D417,522 | S | 12/1999 | Klaus | |
| 10,670,203 | B1 | 6/2020 | Glazer et al. | |
| 11,304,274 | B1 * | 4/2022 | Fu | H04N 5/23299 |
| 2020/0109824 | A1 * | 4/2020 | Ludwig | F21K 9/235 |

OTHER PUBLICATIONS

Better Homes & Gardens Vanity Sconce—Modern Farmhouse [online]. Walmart, Nov. 9, 2021. Retrieved from the Internet: <URL:https://www.walmart.com/ip/Better-Homes-Gardens-Vanity-Sconce-Modem-Farmhouse-Oil-Rubbed-Bronze-Finish/278167338>.

Better Homes & Gardens Outdoor Goose Neck Wall Light [online], Walmart, Nov. 9, 2021. Retrieved from the Internet: <URL:https://www.walmart.com/ip/Better-Homes-Gardens-Outdoor-Goose-Neck-Wall-Light-Bronze-60W/912155677>.

Catalog Page for Nautical Fixtures. Inter-Global Inc. Product Catalog. Published May 1, 2007. p. C3-C4.

* cited by examiner

*Primary Examiner* — Peggy A Neils
(74) *Attorney, Agent, or Firm* — Creativenture Law, LLC; Kevin C. Staed; Dennis J M Donahue, III

(57) ABSTRACT

A non-unitary light fixture having a housing, neck and wall panel that is affixed to a wall or other supporting structure. The fixture includes a separable neck that mounts to the housing and wall panel on opposite ends with a water-tight seal created by a flange on each end of the neck. The flange overlaps the perimeter of respective mounting apertures within the housing and wall panel and thereby prevents water from entering either the housing or wall panel. The fixture further includes a tube extending between the housing and wall panel for routing electrical wires to a lighting assembly housed within the shade.

20 Claims, 9 Drawing Sheets

LIGHT FIXTURE WITH FLANGE OVER GOOSE NECK CONNECTION

CROSS-REFERENCE TO RELATED APPLICATIONS

This application is an original US Non-Provisional Patent Application and makes no claim to an earlier filing date.

STATEMENT REGARDING FEDERALLY SPONSORED RESEARCH

Not Applicable.

APPENDIX

Not Applicable.

BACKGROUND OF THE INVENTION

Field of the Invention

The present invention generally relates to the field of light fixtures, and more particularly to wall mounted sconces.

Related Art

Wall sconce type light fixtures have long been used on the interior and exterior of buildings, homes and other structures as decor and to illuminate surrounding areas. Generally, these wall-mounted light fixtures include a base section that is attached to the supporting structure with common fasteners and a shade attached to the base section. The wiring used to power the light fixture are routed from the electrical system of the structure, through the base section and to lighting assembly supported within the shade, such as a socket assembly or LED assembly. For example, the Vanity Sconce by BETTER HOME & GARDEN® includes a base section that mounts to a wall, a shade for housing the lighting assembly and a neck connecting the base and shade. Subsequently, light is emitted from the light fixture with the shade directing the light emanating from the bulb during use while also protecting the lighting assembly from potentially harmful environmental conditions, such as rain when the sconce is used on the exterior of a structure.

Although unitary fixtures may be molded into a single unit, it will be understood that many light fixtures are made up of various sub-elements that are assembled together with fasteners. A problem arises in non-unitary fixtures which include seams at the junction of the differing sub-elements. These junction points are particularly a problem in light fixtures that are intended to be used outdoors and exposed to various environmental conditions. For example, seams where the fasteners engage the shade to connect the shade to the supporting neck create a potential leak point where rain water could enter and potentially damage the lighting assembly housed within. Accordingly, there is a desire to those in the art to provide an improved non-unitary light fixture that includes a water tight seal at the various junctions of the various sub-elements.

SUMMARY OF THE INVENTION

The invention described herein is a non-unitary light fixture having a housing with a shade and roof, neck and wall panel for attachment to a wall and which is particularly suited for outdoor use. A gooseneck is provided with a single fastener on each end to connect the roof of the housing to the wall mount while providing a water-tight seal to protect the light assembly held within the housing and electrical wiring routed from the base structure through the wall panel.

In one aspect of the invention the number of apertures for assembling the non-unitary fixture is limited to a single fastening point and a water-tight seal is provided. To create the water-tight seal, flanges on each end of the neck overlap the perimeter of respective mounting apertures within the shade and wall panel and thereby prevents water from entering either the shade or wall panel. Alternatively, one end of the neck may be fixed to the housing or wall panel and only a single flange is needed to create a water tight seal with the releasable end.

In another aspect of the invention, a wiring tube extends between the housing and wall panel for routing electrical wires to a lighting assembly situated within the housing. The tube may releasably engage other apertures in the housing and wall mount spaced from the mounting apertures or may be integrally formed with one or both of the housing and wall mount.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
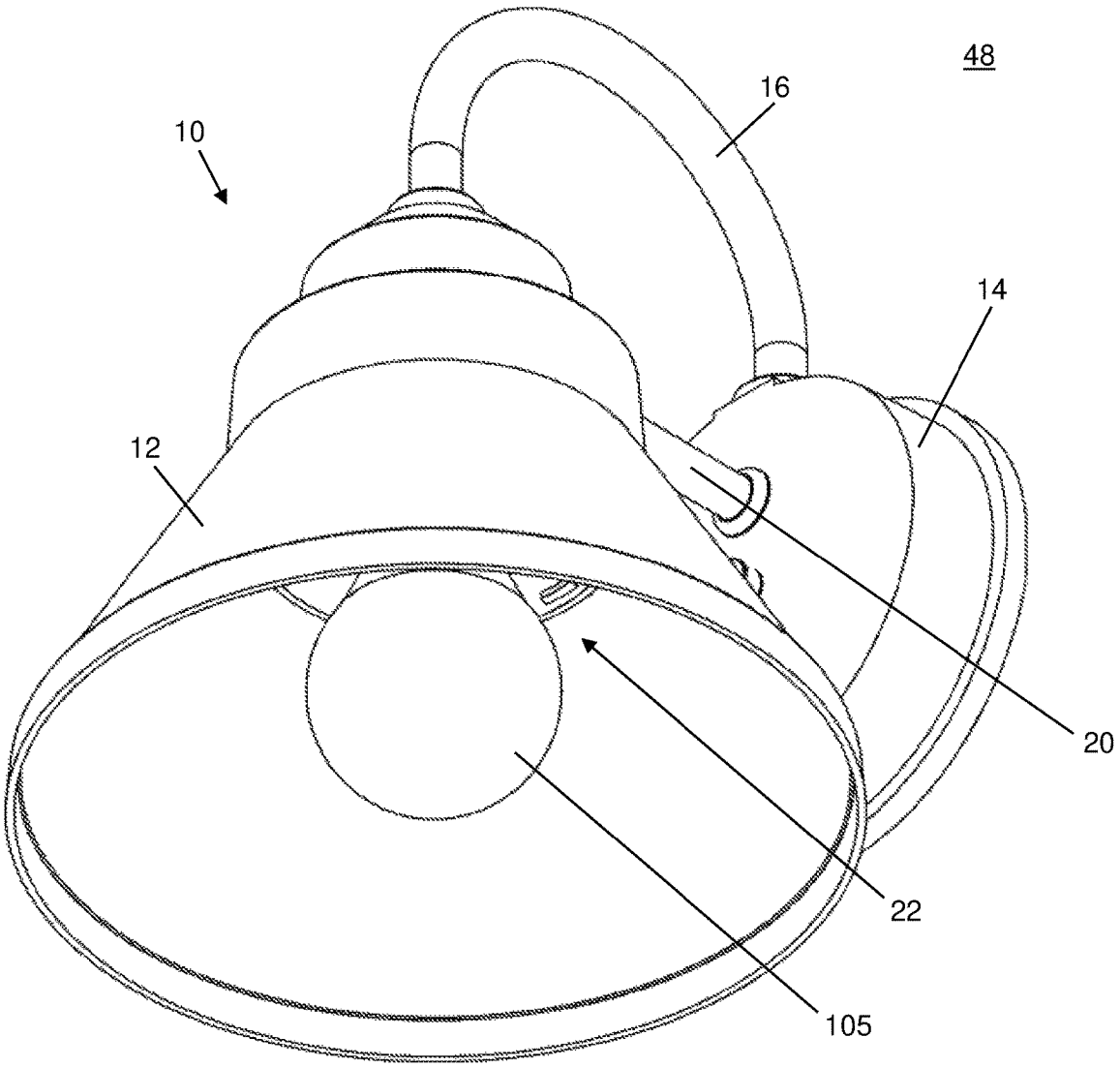
FIG. 1A is a perspective view of a light fixture according to the invention described herein.

The following description of the preferred embodiment(s) is merely exemplary in nature and is in no way intended to limit the invention, its application, or uses.

The light fixtures 10 shown in FIGS. 1A-1G and FIGS. 2A-2G include a wall panel 14 for mounting to the wall of a structure 100, a housing 12 having a shade 26 with a roof 28 for holding a lighting assembly 22 and a neck 16 connecting the housing to the wall panel with fasteners 18 respectively situated on the interior 30*b* of the roof and the back face 38*b* of the wall panel. In the preferred embodiment the entire fixture can be disassembled with the neck separated from the wall panel and housing such that a seam is created between apertures in the wall panel and roof when the opposing ends of the neck are fastened thereto in the assembled configuration. To create a water-tight seal between the neck, wall panel and housing, flanges are provided at each end of the neck which overlap the perimeter of the mounting apertures through which the fasteners extend to assemble the light fixture.

A lighting assembly holding a light 105 is provided within the housing and preferably includes a socket assembly 84 that is connected to the light fixture through a bracket 88 spaced a distance (d) beneath the roof and spanning the interior width of the shade ($W_{S'''}$) at a location between the roof and periphery that is. The socket assembly has a light socket 86 held tight to the bracket with a fastener 90 or integrated therewith. Alternatively, a light emitting diode (LED) assembly may be provided in place of the socket assembly with LED strings that are arranged on a circuit board that will fit easily within an LED light unit. The strings are preferably arranged on the circuit board in a particular physical configuration that can match the shape of the shade. For example, it will be appreciated that a circular LED assembly would fit well in the circular light fixtures shown the drawings. In particular, strings of LEDS could be distributed along the interior sidewall of the shade with other LEDs distributed along inner rings of a circular circuit board to help distribute the light output of the whole LED light assembly.

The shade of the housing slopes downward from the perimeter 32 of the roof to a peripheral edge 36 and has a narrowest width ($W_{S'}$) at the edge of the roof and widest width at the peripheral edge ($W_{S''}$) ($W_{S'}<W_{S''}<W_{S'''}$). The roof includes an aperture 34*a* with a perimeter 34*b* that receives the fastener connecting one end of the neck 42*a* to the roof as further explained herein. Opposite from the housing, the wall panel is fixedly attached on the back face of the panel to the supporting wall or other supporting structure. To attach the wall panel to the housing, another aperture 40*a* having another perimeter 40*b* is provided in the wall panel and the opposite end of the neck 42*b* is secured thereto with another fastener.

As described above, the ends of the neck respectively attach to the roof of the housing and the wall panel with the neck extending the neck length ($L_N$) between the opposing ends. As shown in the drawings, it will be appreciated that the neck length may be curved into a goose neck or other shape. In the preferred embodiment described herein, each end of the neck is releasable but alternative embodiments may include a single releasable end with the opposite end of the neck being fixedly attached to the housing or wall panel. When assembled, one end of the neck abuts the exterior 30*a* of the roof and surrounds the perimeter of the aperture therein while the opposite end of the neck abuts the front face 38*a* of the wall panel and surrounds the perimeter of the aperture in the wall panel. To connect the neck to the shade and wall panel, fasteners extend through the respective apertures and releasably secure the neck thereto.

Figures 1B, 1C:
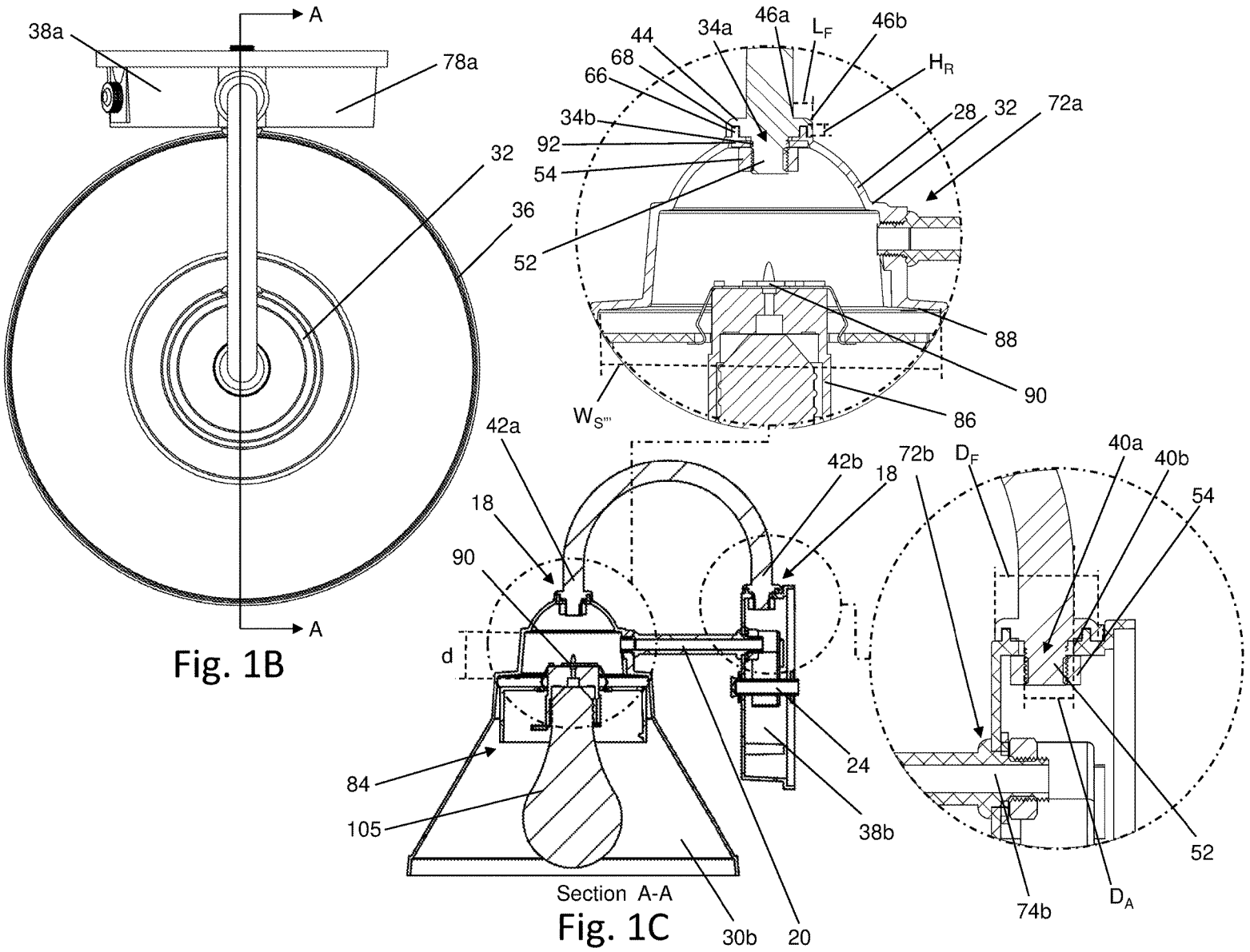
FIGS. 1B and 1C respectively show a top view and a side cross-sectional view of the light fixture shown in FIG. 1A.
Figure 1E:
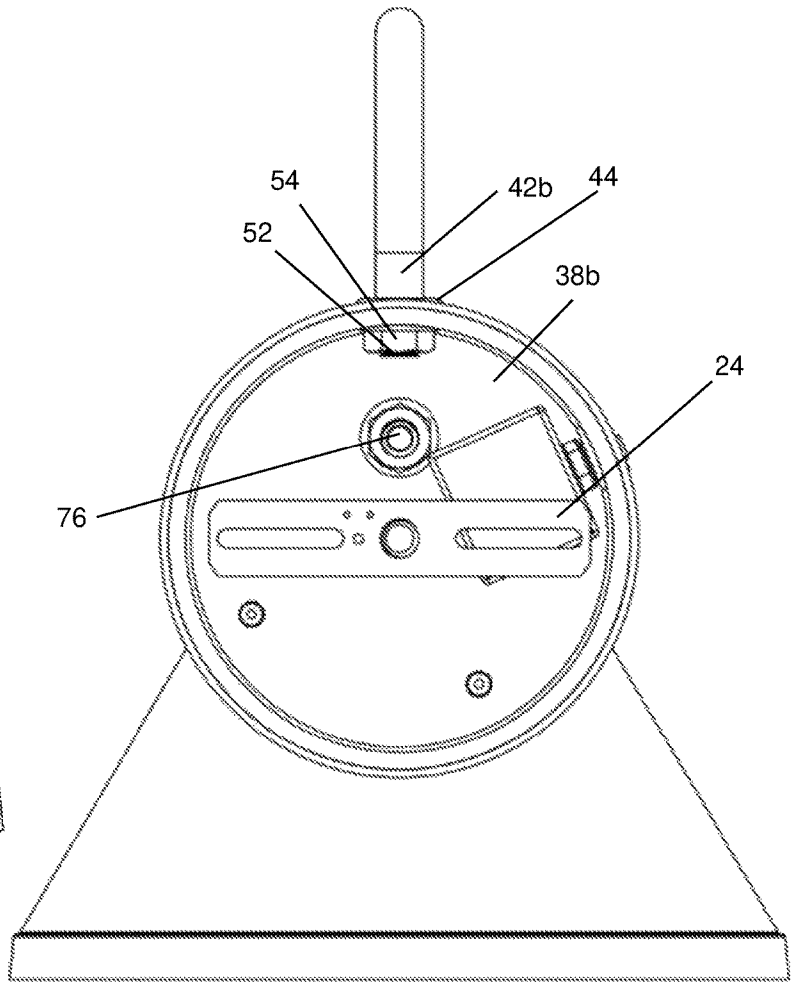
FIGS. 1D and 1E respectively show a front view and a rear view of a light fixture shown in FIG. 1A.
Figure 1D:
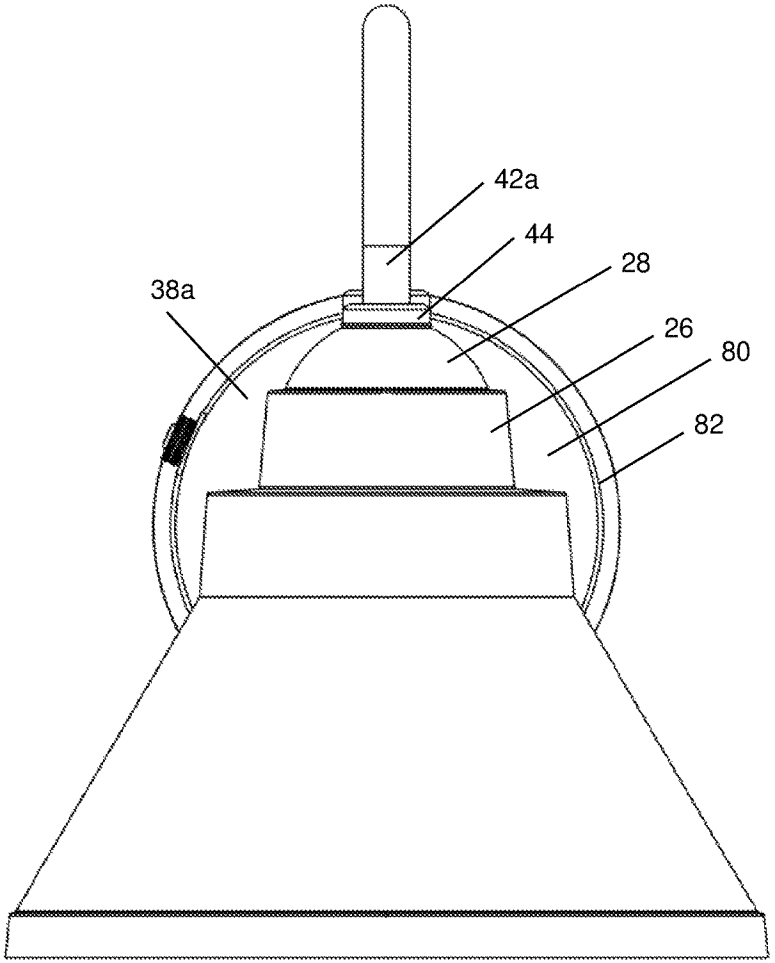
Figure 1G:
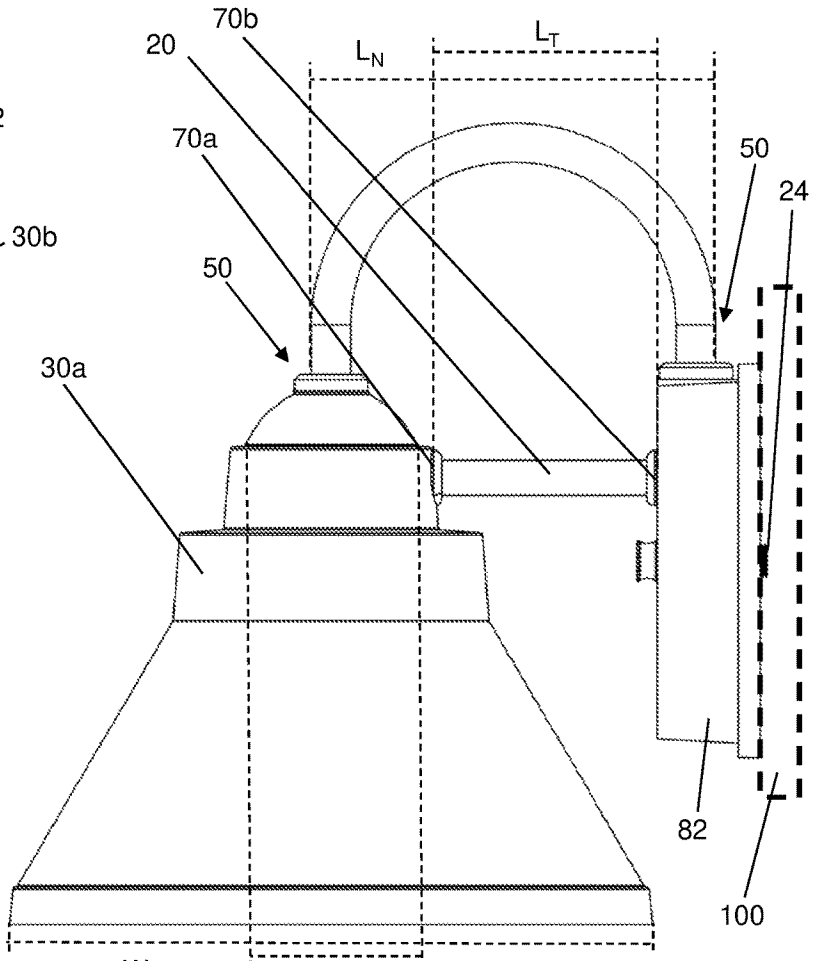
FIGS. 1F and 1G respectively show a bottom view and a sideview of the light fixture shown in FIG. 1A.
Figure 1F:
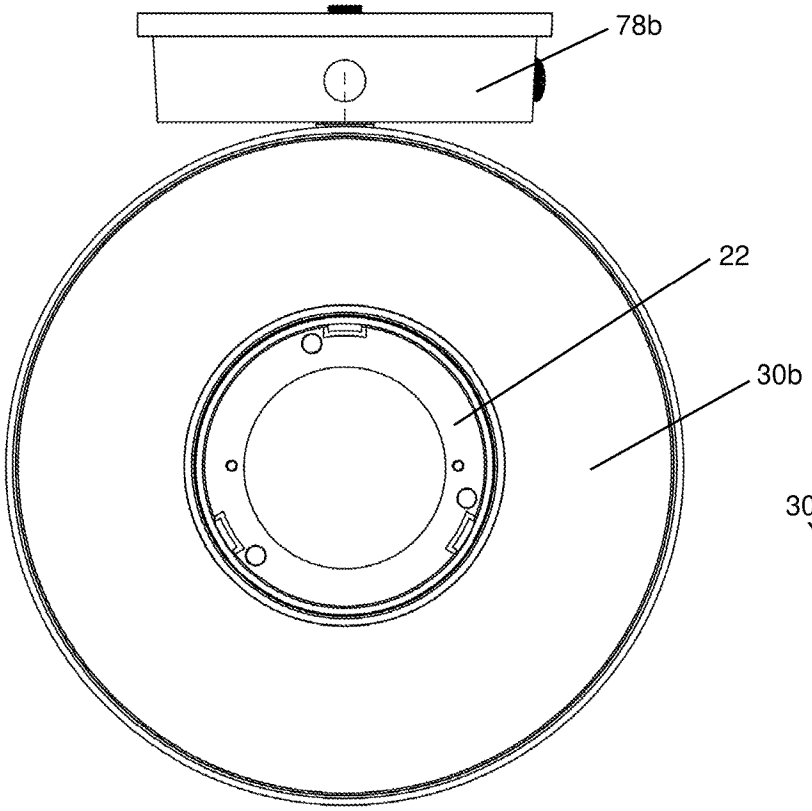
Figure 2A:
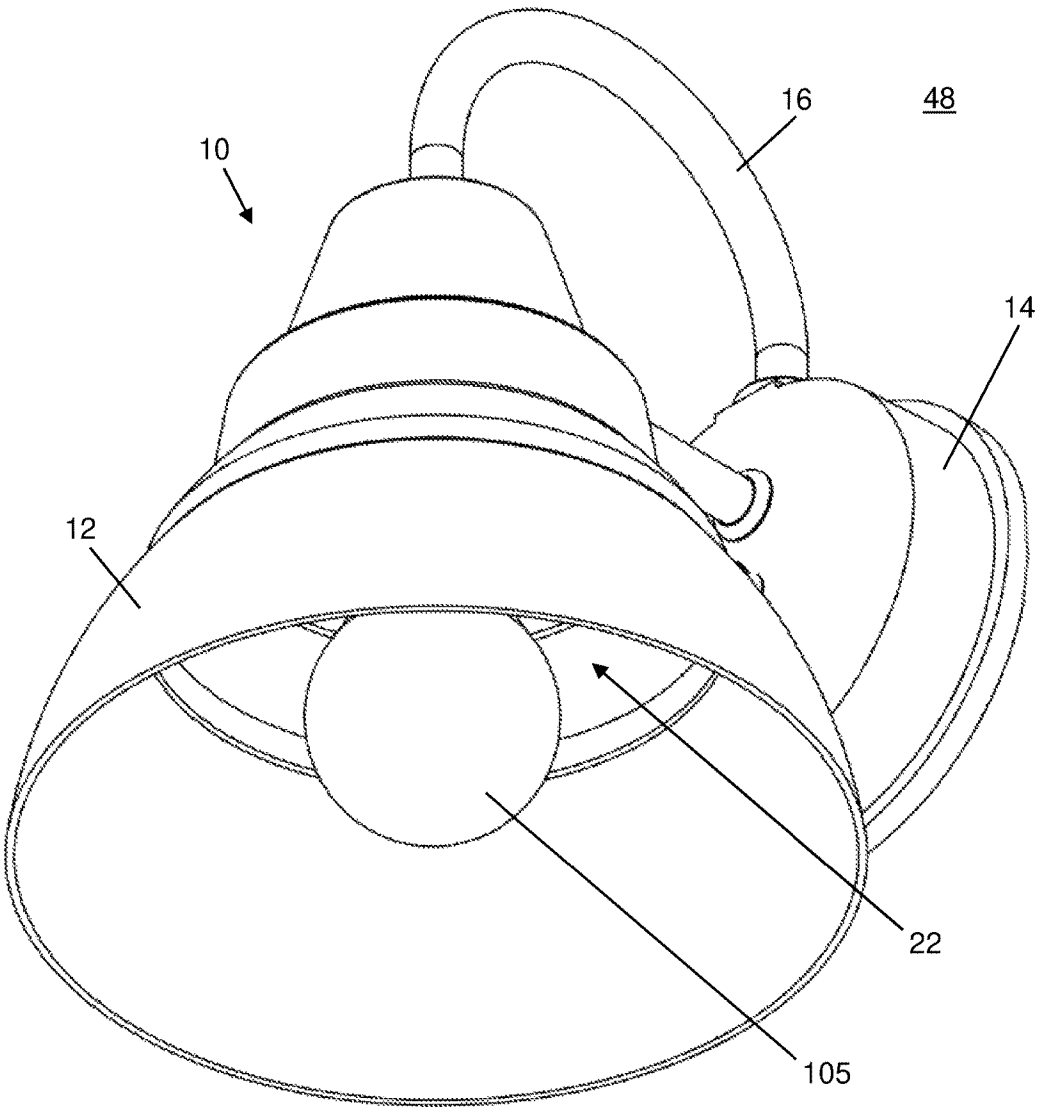
FIG. 2A is a perspective view of an alternative light fixture according to the invention described herein.
Figures 2B, 2C:
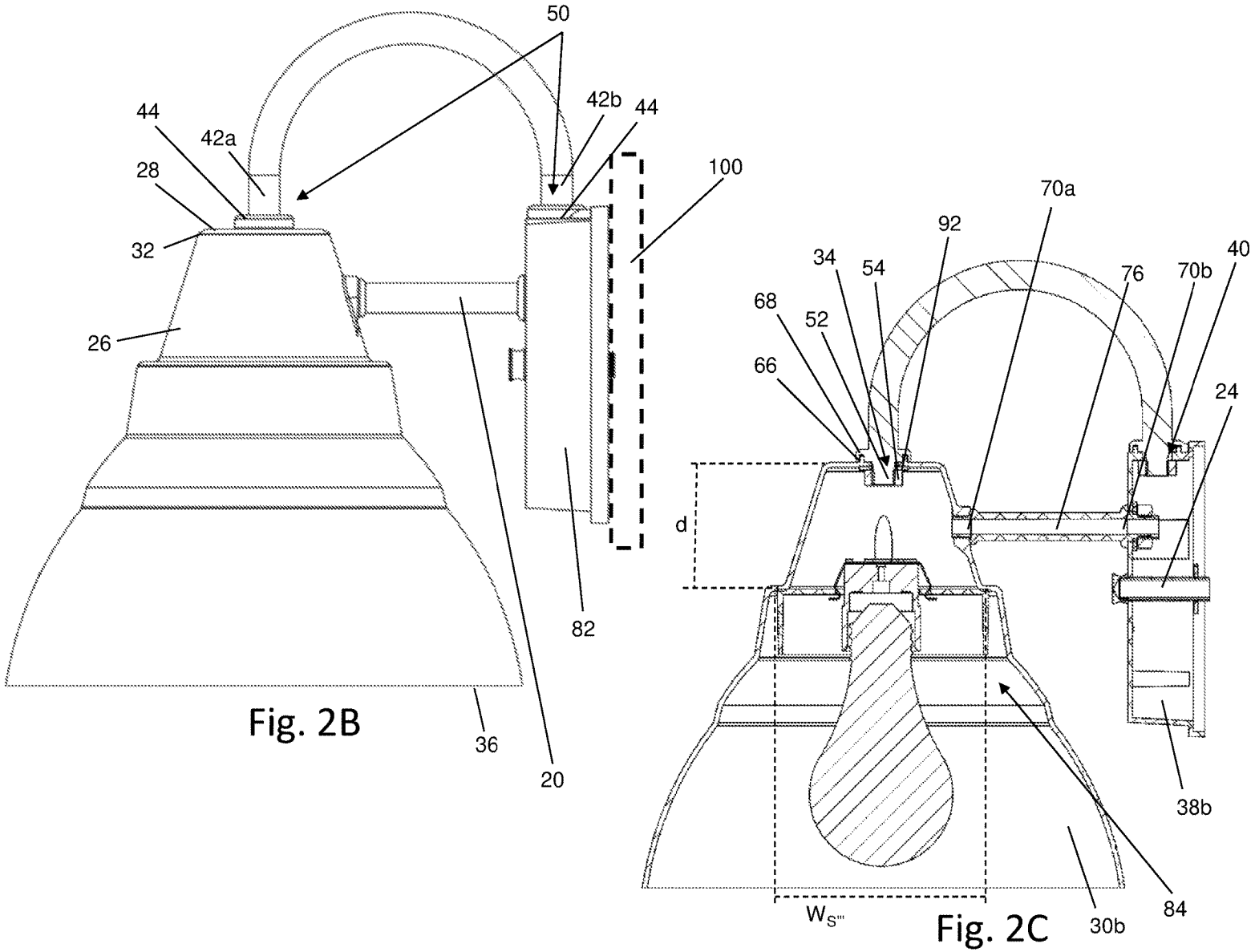
FIGS. 2B and 2C respectively show a sideview and a side cross-sectional view of the alternative light fixture shown in FIG. 2A.
Figure 2E:
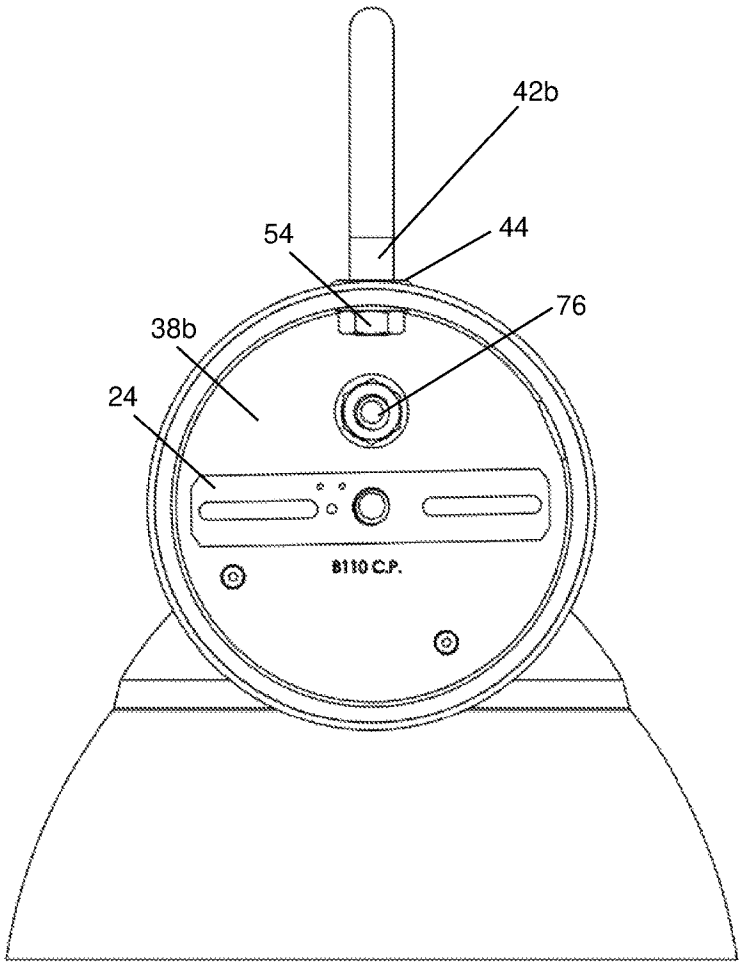
FIGS. 2D and 2E respectively show a front view and a rear view of the alternative light fixture shown in FIG. 2A.
Figure 2D:
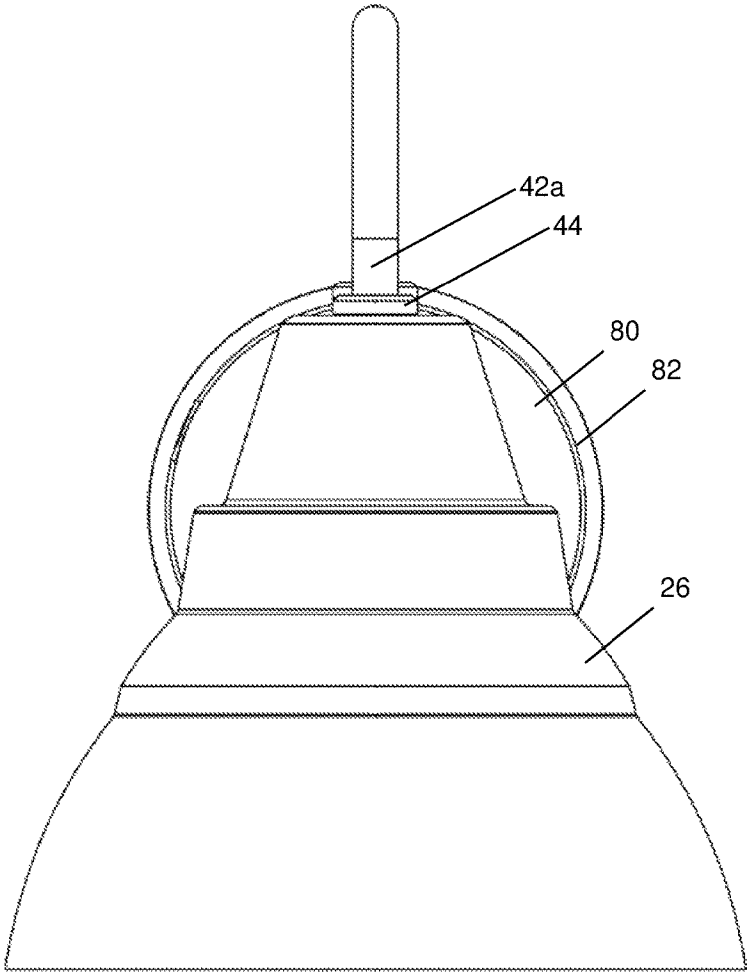
Figure 2G:
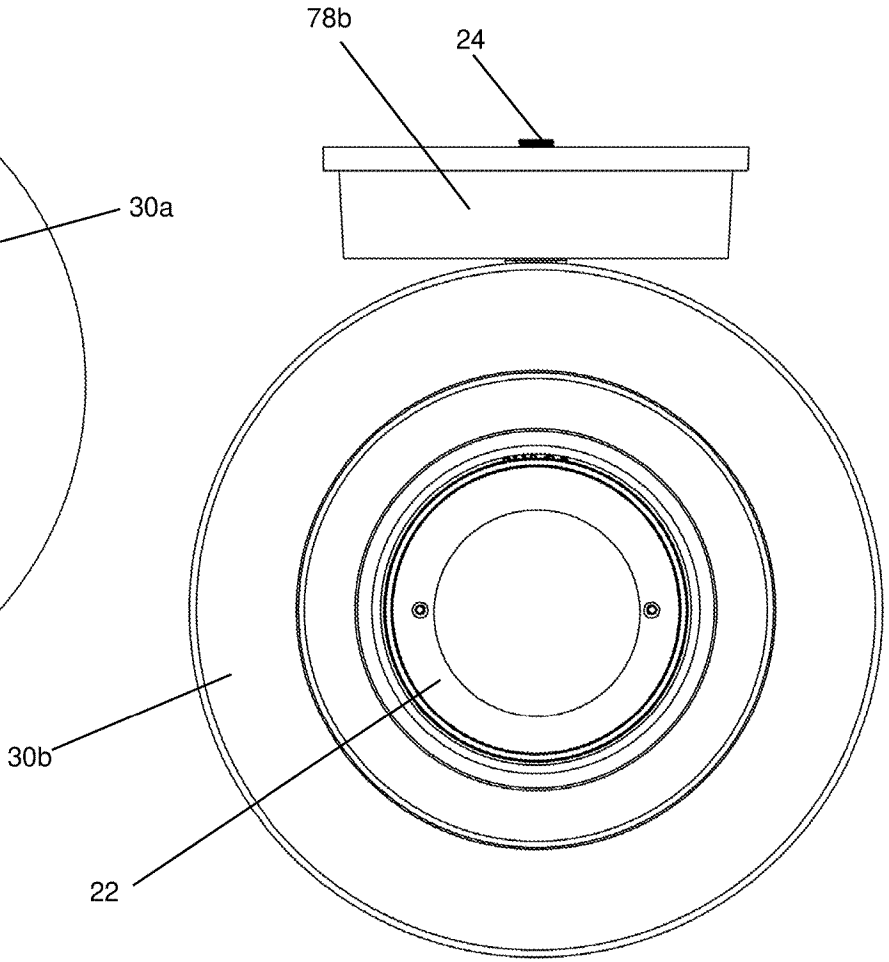
FIGS. 2F and 2G respectively show a top view and a bottom view of the alternative light fixture shown in FIG. 2A.
Figure 2F:
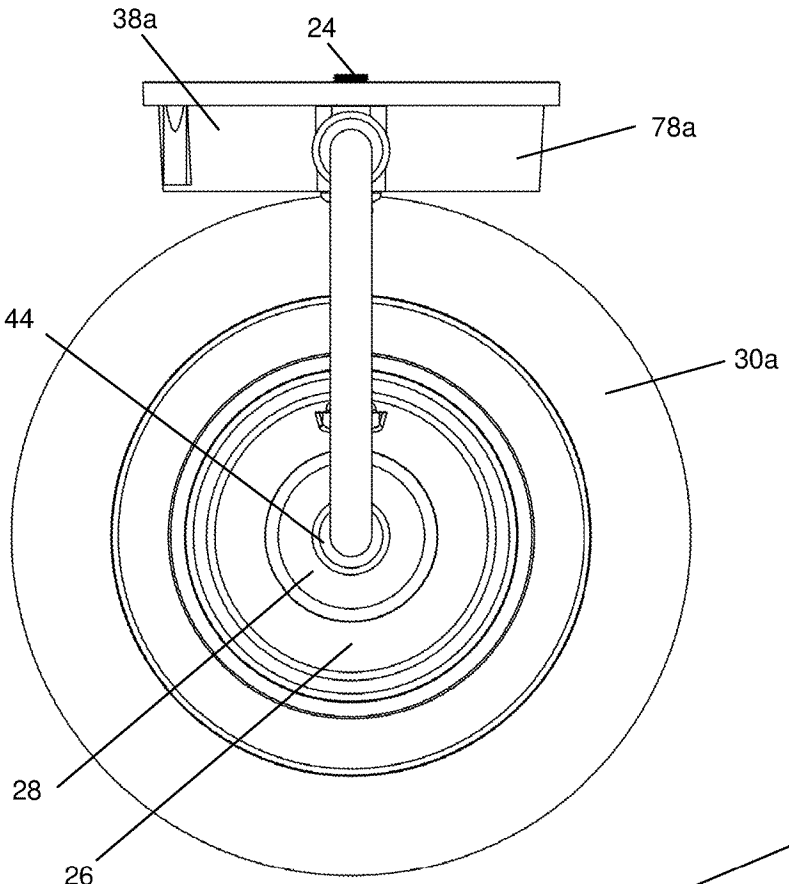
Figure 4:
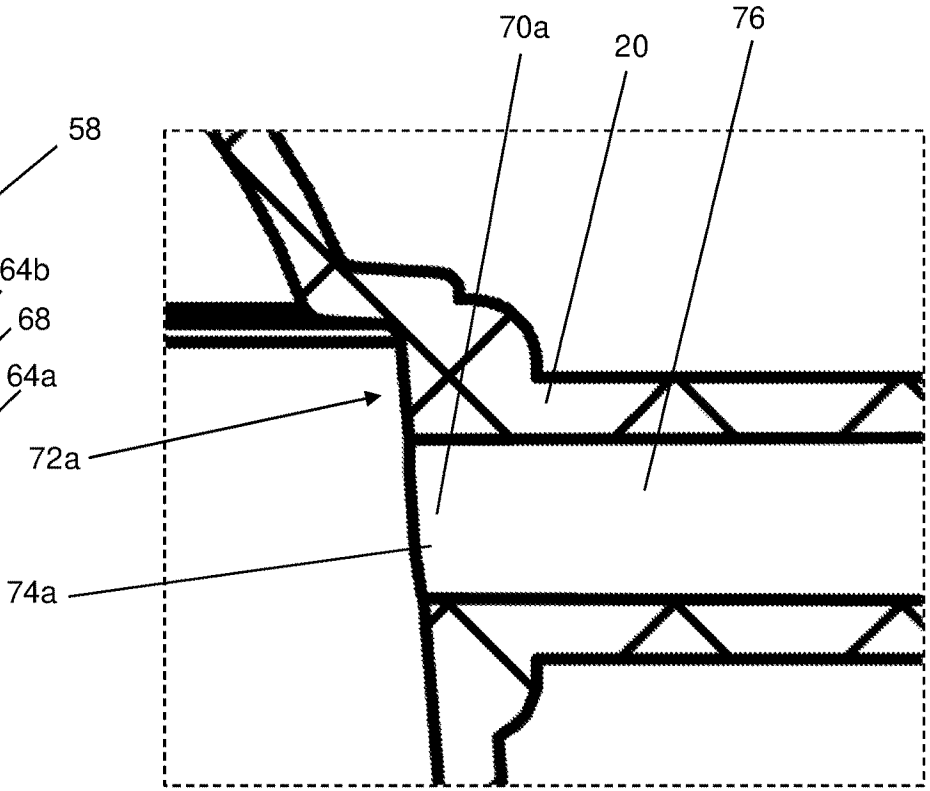
FIG. 4 shows a detail view of an alternative tube mount configuration according to the invention described herein.

As particularly shown in FIG. 1C and FIG. 2C, various fastener types may be used to fasten the neck to the roof of the housing and wall panel. Further, the particular fastener type may differ between opposite ends of the neck without deviating from the scope of the present invention. For example, the fasteners connecting the wall panel and housing to the neck in FIG. 1C each include an externally-threaded protrusion 52 extending a length from the ends of the neck into the apertures in the housing and wall panel. A nut 54 and washer 92 are secured on the ends of threaded protrusion on the interior of the wall panel and housing to connect the neck and wall panel together. Alternatively, the roof of the housing may include an internally-threaded integrated section that receives the threaded protrusion at the end of the neck such that no additional nut or fastener is needed.

Figure 3:
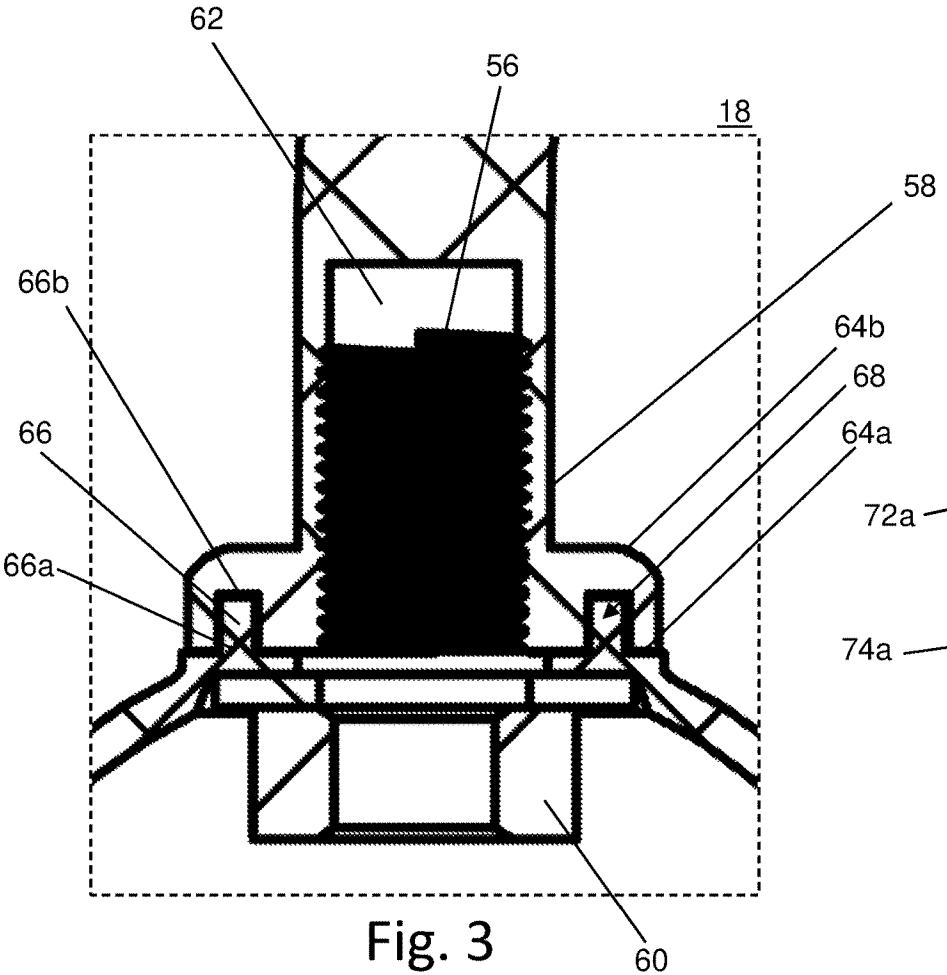
FIG. 3 shows a detail view of an alternative neck mount configuration according to the invention described herein.

FIG. 3 shows another alternative fastener embodiment with an internally threaded bore 62 in the end of the neck. A bolt 56 having a threaded length 58 is received within the bore to connect the neck to the housing or wall panel. To secure the fastener, a head 60 is provided on the end of the bolt to allow the bolt to be secured from the interior of the housing or wall panel.

To create a water-tight seal between the ends of the neck and the respective apertures through which the fasteners extend to connect the neck to the housing and the wall panel, flanges 44 are provided around the ends of each neck and overlap the perimeter edge of each aperture. As particularly shown in the cross-sectional views of FIGS. 1C and 2C, each flange has a proximal edge 46*a* around the ends of the neck and a distal edge 46*b* that is radially spaced a flange length $L_F$ from the proximal edge. Thus, each flange has a diameter ($D_F$) that is larger than the diameter of the apertures in the roof and wall panel (DA) to allow the flanges to overlap the perimeter of the apertures in the assembled configuration 48 to create a water-tight seal 50.

To further effect a water-tight seal, a ring 66 is provided around the apertures in the roof and wall panel with a bottom edge 66*a* respectively connected to the exterior of the roof and front face of the wall panel and a top edge 66*a* spaced a height ($H_R$) from the bottom edge. The rings are subsequently received within a groove 68 in the inner surface of the flange 64*a* that abuts the roof and wall panel while the outer surface 64*b* sheds water away from the seal. Accordingly, even if the fasteners connecting the neck to the shade and wall panel are slightly loosened, a seal is still provided and water cannot enter the top of the shade or wall panel through the mounting apertures.

Although the rings, flanges and grooves depicted in the preferred embodiments are circumferential in shape, it will be appreciated that the particular shape is not intended to be limiting. For example, a square neck corresponding to a square aperture may be used in alternative fixture designs and it will be appreciated that a square flange and ring matching the shape of the neck and aperture will be used. In operation, the flange still overlaps the perimeter of the aperture and the groove in the flange receives the corresponding ring on the shade and wall panel to create a water-tight seal. Further still, the roof of the housing and top side of the wall panel are otherwise devoid of any other apertures such that water could only enter through the top mounting apertures when the fasteners are removed and the entire fixture is disassembled with the rings removed from the respective grooves.

To provide power to the lighting assembly within the shade, a tube 20 is provided between the housing and the wall panel and extends a tube length ($T_L$) therebetween. One end of the tube 70*a* connects around an aperture 74*a* in the outer section of the housing at a mounting position 72*a* spaced from the roof while the other end 70*b* connects around an aperture 74*b* in front face of the wall panel at another mounting position 72*b* spaced from the neck mounting aperture. A central bore 76 extends through the length of the tube and can receive the wiring used for traditional light sockets that hold different types of screw-in bulbs, such as incandescent bulbs, compact fluorescent lamps with electronic ballasts, and LED bulbs with AC-DC driver circuitry.

To connect the tube to the shade and/or the wall panel, an externally threaded collar may be provided at the end of the tube which respectively protrudes into the apertures at the tube mounting positions in the housing and wall panel. To secure the ends of the tube, a nut engages the end of the collar and a washer may also be provided, such as shown in the wall panel of FIGS. 1C and 2C. Alternatively, the tube mounting aperture may further include a threaded section to allow the threaded end of the tube to threadingly secure within the threaded aperture rather than a separate nut. Further still, as shown in the shade of FIG. 1C, the end of the tube may also be integrated with the housing or wall panel itself.

Although the particular shape of the wall panel, housing and neck is not intended to be limiting, the light fixture in the preferred embodiment includes a gooseneck extending between the roof of the housing and a top side 78*a* of the wall panel. The wall panel further includes a front side 80, bottom side 78*b* and a side edge 82 extending between the top and bottom side with the tube connecting to the front side and an open back face attaching the panel to the wall with a wall mounting bracket 24. In the preferred embodiment with the gooseneck shape, the length of the tube is less than half the neck length.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A light fixture, comprising:

a housing comprising a shade, a roof, an interior and an exterior, wherein the roof comprises a roof perimeter and a first aperture having a first perimeter and a first diameter, and wherein the shade slopes downward from the roof perimeter to a periphery;

a wall panel comprising a front face, a back face, and a second aperture having a second perimeter and a second diameter;

a neck extending a neck length between a first neck end and a second neck end, wherein the first neck end is connected to the exterior surface of the roof around the first aperture, wherein the second neck end is connected to the front face of the wall panel around the second aperture, wherein the neck further comprises a flange having a proximal edge connected around at least one of the first neck end and the second neck end, a distal edge radially spaced a flange length from the proximal edge and a flange diameter, wherein the flange diameter is greater than the first diameter and the second diameter, wherein the flange overlaps one of the first perimeter and the second perimeter of the first aperture and the second aperture in an assembled configuration, wherein the flange comprises a groove, wherein at least one of the roof and the wall panel further comprise a ring respectively surrounding the first perimeter of the first aperture on the exterior of the roof and the second perimeter of the second aperture on the front surface of the wall panel, wherein the ring is received within the groove in the assembled configuration, and wherein the assembled configuration consists of a water-tight seal between the flange and at least one of the first perimeter and the second perimeter; and a fastener releasably connecting at least one of the first neck end and the second neck end having the flange to the roof and the wall panel, respectively, in the assembled configuration.

2. The light fixture of claim 1, wherein fastener comprises an externally-threaded protrusion and a nut, wherein the externally-threaded protrusion extends from at least one of the first neck end and the second neck end and protrudes into the first aperture and the second aperture in the assembled configuration, and wherein the nut respectively engages the externally-threaded protrusion on at least one of the interior of the roof around the first aperture and the back face of the wall panel around the second aperture.

3. The light fixture of claim 1, wherein the fastener consists of a bolt comprising a threaded length and a head, wherein at least one of the first neck end and the second neck end further comprise a threaded bore, wherein the threaded length of the bolt protrudes through at least one of the first aperture and the second aperture and threadedly engages the threaded bore, and wherein the head is respectively positioned on at least one of the interior of the roof around the first aperture and the back face of the wall panel around the second aperture.

4. The light fixture of claim 1, wherein the flange further comprises an inner surface abutting at least one of the roof and the wall panel in the assembled configuration and an outer surface facing away from the inner surface, and wherein the groove is situated within the inner surface.

5. The light fixture of claim 1, further comprising a tube extending a tube length between a first tube end and a second tube end, wherein the first tube end is connected to the housing at a housing mounting position, wherein the second tube end is connected to the front face of the wall panel at a wall panel mounting position, wherein the housing mounting position and the wall panel mounting position are each spaced from the first aperture and the second aperture and respectively comprise a third aperture and a fourth aperture, and wherein the tube further comprises a hollow bore through the tube length.

6. The light fixture of claim 5, the wall panel further comprises a top side, a front side, a bottom side and a pair of side edges, wherein the second aperture is positioned on the top side, and wherein the fourth aperture is positioned on the front side of the wall panel.

7. The light fixture of claim 5, wherein the tube length is less than half the neck length.

8. The light fixture of claim 1, further comprising a socket assembly comprising a light socket, and wherein the socket assembly is fixed to a mounting bracket within the interior of the housing.

9. The light fixture of claim 1, wherein the roof of the housing is devoid of any additional apertures.

10. The light fixture of claim 1, further comprising a wall mount assembly fixedly connected to the back face of the wall panel.

11. A light fixture, comprising:

a housing comprising a shade, a roof, an outer section, an interior and an exterior, wherein the roof comprises a roof perimeter and a first aperture having a first perimeter and a first diameter, and wherein the shade slopes downward from the roof perimeter to a periphery, a wall panel comprising a front face, a back face, and a second aperture having a second perimeter and a second diameter;

a neck extending a neck length between a first neck end and a second neck end, wherein the first neck end is releasably connected to the exterior surface of the roof around the first aperture, wherein the second neck end is releasably connected to the front face of the wall panel around the second aperture, wherein each of the first neck end and the second neck end further comprise a flange comprising an inner surface, an outer surface, a proximal edge respectively connected around the first neck end and the second neck end, a distal edge radially spaced a flange length from the proximal edge, a flange diameter, and a groove recessed from the inner surface between the proximal edge and the distal edge, wherein the flange diameter is greater than the first diameter and the second diameter, wherein the flanges respectively overlap the first perimeter and the second perimeter of the first aperture and the second aperture in an assembled configuration, wherein the inner surfaces respectively engage the roof and the wall panel in the assembled configuration, and wherein the assembled configuration consists of a water-tight seal between the flanges, the first perimeter and the second perimeter;

a pair of rings respectively surrounding the first perimeter of the first aperture on the exterior of the shade and the second perimeter of the second aperture on the front surface of the wall panel, and wherein each of the respective rings are received within the respective grooves in the assembled configuration; and a pair of fasteners respectively connecting the first neck end to the roof and the second neck end to the wall panel in the assembled configuration.

12. The light fixture of claim 11, wherein at least one of the fasteners in the pair of fasteners consists of an externally-threaded protrusion and a nut, wherein the externally-threaded protrusion extends from at least one of the first neck end and the second neck end and protrudes into the first aperture and the second aperture in the assembled configuration, and wherein the nut respectively engages the externally-threaded protrusion on at least one of the interior of the shade around the first aperture and the back face of the wall panel around the second aperture.

13. The light fixture of claim 11, wherein at least one of the fasteners in the pair of fasteners consist of a bolt comprising a threaded length and a head, wherein at least one of the first neck end and the second neck end further comprise a threaded bore, wherein the threaded length of the bolt respectively protrudes through at least one of the first aperture and the second aperture and threadedly engage the threaded bore, and wherein the head is respectively positioned on at least one of the interior of the shade around the first aperture and the back face of the wall panel around the second aperture.

14. The light fixture of claim 11, further comprising a tube extending a tube length between a first tube end and a second tube end, wherein the first tube end is connected to the outer section of the housing at a housing mounting position, wherein the second tube end is connected to the front face of the wall panel at a wall panel mounting position, wherein the housing mounting position and the wall panel mounting position are each spaced from the first aperture and the second aperture and respectively comprise a third aperture and a fourth aperture, and wherein the tube further comprises a hollow bore through the tube length.

15. The light fixture of claim 11, further comprising a socket assembly comprising a light socket, and wherein the socket assembly is fixed to a mounting bracket within the interior of the shade.

16. The light fixture of claim 11, wherein the roof of the housing is devoid of any additional apertures.

17. A light fixture, comprising:

a housing comprising a shade, a roof, an interior and an exterior, wherein the roof comprises a roof perimeter and a first aperture having a first perimeter and a first diameter, and wherein the shade slopes downward from the roof perimeter to a periphery;

a wall panel comprising a front face, a back face, and a second aperture having a second perimeter and a second diameter;

a neck extending a neck length between a first neck end and a second neck end, wherein the first neck end is connected to the exterior surface of the roof around the first aperture, wherein the second neck end is connected to the front face of the wall panel around the second aperture, wherein the neck further comprises a flange having a proximal edge connected around at least one of the first neck end and the second neck end, a distal edge radially spaced a flange length from the proximal edge and a flange diameter, wherein the flange diameter is greater than the first diameter and the second diameter, wherein the flange overlaps one of the first perimeter and the second perimeter of the first aperture and the second aperture in an assembled configuration, wherein the flange further comprises an inner surface respectively abutting at least one of the roof and the wall panel in the assembled configuration, an outer surface facing away from the inner surface and a groove within the inner surface, wherein at least one of the roof and the wall panel further comprise a ring respectively surrounding the first perimeter of the first aperture on the exterior of the roof and the second perimeter of the second aperture on the front surface of the wall, and wherein the ring is received within the groove in the assembled configuration, and wherein the assembled configuration consists of a water-tight seal between the flange and at least one of the first perimeter and the second perimeter; and a tube extending a tube length between a first tube end and a second tube end, wherein the first tube end is connected to the housing at a housing mounting position, wherein the second tube end is connected to the front face of the wall panel at a wall panel mounting position, wherein the housing mounting position and the wall panel mounting position are each spaced from the first aperture and the second aperture and respectively comprise a third aperture and a fourth aperture, and wherein the tube further comprises a hollow bore through the tube length; and a fastener releasably connecting at least one of the first neck end and the second neck end having the flange to the roof and the wall panel, respectively, in the assembled configuration.

18. The light fixture of claim 17, wherein the fastener consists of an externally-threaded protrusion and a nut, wherein the externally-threaded protrusion extends from at least one of the first neck end and the second neck end and protrudes into the first aperture and the second aperture in the assembled configuration, and wherein the nut respectively engages the externally-threaded protrusion on at least one of the interior of the shade around the first aperture and the back face of the wall panel around the second aperture.

19. The light fixture of claim 17, wherein the fastener consists of a bolt comprising a threaded length and a head, wherein at least one of the first neck end and the second neck end further comprise a threaded bore, wherein the threaded length of the bolt respectively protrudes through at least one of the first aperture and the second aperture and threadedly engage the threaded bore, and wherein the head is respectively positioned on at least one of the interior of the shade around the first aperture and the back face of the wall panel around the second aperture.

20. The light fixture of claim 17, wherein the roof of the housing is devoid of any additional apertures.

* * * * *